US009199294B2

(12) United States Patent
Lange et al.

(10) Patent No.: US 9,199,294 B2
(45) Date of Patent: Dec. 1, 2015

(54) METHOD AND DEVICE FOR MANUFACTURING A CORRUGATED METAL PIPE

(71) Applicant: NEXANS, Paris (FR)

(72) Inventors: Nico Lange, Wunstorf (DE); Christian Reiter, Sarstedt (DE); Christian Frohne, Hannover (DE); Holger Schulz, Hannover (DE); Michael Meyer, Burgwedel (DE)

(73) Assignee: NEXANS, Paris (FR)

( * ) Notice: Subject to any disclaimer, the term of this patent is extended or adjusted under 35 U.S.C. 154(b) by 0 days.

(21) Appl. No.: 14/480,672

(22) Filed: Sep. 9, 2014

(65) Prior Publication Data

US 2015/0068263 A1 Mar. 12, 2015

(30) Foreign Application Priority Data

Sep. 10, 2013 (EP) ..... 13306238
Aug. 15, 2014 (EP) ..... 14181109

(51) Int. Cl.
*B21D 15/06* (2006.01)
*B21C 37/16* (2006.01)
*B21C 37/20* (2006.01)

(52) U.S. Cl.
CPC ..... *B21D 15/06* (2013.01); *B21C 37/16* (2013.01); *B21C 37/205* (2013.01)

(58) Field of Classification Search
CPC ..... B21D 15/00; B21D 15/04; B21D 15/06; B21C 37/06; B21C 37/205; B21C 37/16
See application file for complete search history.

(56) References Cited

U.S. PATENT DOCUMENTS 3,143,794 A * 8/1964 Martin-Hurst ..... 29/454
3,973,424 A 8/1976 Albes et al.
5,461,767 A * 10/1995 Okubo ..... 29/454

FOREIGN PATENT DOCUMENTS

CH 496490 11/1970

* cited by examiner

*Primary Examiner* — Teresa M Ekiert
(74) *Attorney, Agent, or Firm* — Sofer & Haroun, LLP

(57) ABSTRACT

A corrugating unit is used which presses a first corrugation into the pipe which is moved in its longitudinal direction through the corrugating device. The spacing between the wave peaks is subsequently reduced, for obtaining a second corrugation, by a clamping unit composed of two separately arranged clamping devices resting against the pipe. The pipe provided with a first corrugation is pressed continuously by the first clamping device against a fixed point realized by the second clamping device, which, in the position of operation, is arranged, in relation to the clamping device, in axial direction behind the first clamping device. Both clamping devices are removed cyclically from the pipe and are moved back into a new position in the opposite direction of the direction of movement of the pipe and, in this new position, again rest in the two different areas against the pipe.

4 Claims, 2 Drawing Sheets

METHOD AND DEVICE FOR MANUFACTURING A CORRUGATED METAL PIPE

RELATED APPLICATION

This application claims the benefit of priority from European Patent Application No. 13 306 238.0 filed on Sep. 10, 2013 and European Patent Application No. 14 181 109.1 filed on Aug. 15, 2014, the entirety of which are incorporated by reference.

BACKGROUND

1. Field of the Invention

The invention relates to a method of manufacturing a pipe of metal which is corrugated transversely of its longitudinal direction and receives a corrugation consisting of wave peaks and wave valleys. In the method, an corrugating device is used which impresses a first corrugation as a preliminary corrugation into a pipe which is moved in its longitudinal direction through the corrugating device, with a predetermined axial distance between the wave peaks, wherein the distance between the wave peaks is subsequently reduced by a clamping unit resting against the pipe for obtaining a second corrugation. The invention also relates to a device for carrying out the method. (CH 496 490 A).

2. Description of Related Art

Methods and devices for manufacturing pipes which are corrugated transversely of their longitudinal direction have been known and used for years. Because of the corrugation, the pipes are easily bendable and are stable with respect to radial loads. The corrugation may be helically shaped or ring shaped. This is achieved with appropriate devices by pressing the corrugation into a pipe which is smoothed and is moved, in its longitudinal direction. Such pipes can be utilized for transporting liquid or gaseous media. They may also be utilized as electrical conductors for high frequency cables or as jackets for high voltage cables and news cables. The degree of bendability depends largely on the axial distance between the wave peaks and the depth of the corrugation, i.e. on the radial distance of the wave peaks and the respectively adjacent wave valleys.

DE 24 00 842 A1 describes a method and a device for manufacturing a pipe of high flexibility with an corrugation whose wave peaks rest tightly against each of and which has a relatively deep corrugation. After embossing the corrugation in a corrugating device, the pipe is pressed through a pull out device against a ring shaped tool and thereby is upset as a result, so that the axial distance between the wave peaks is reduced.

The above mentioned CH 496 490 A describes an corrugating device for pipes which includes a first arrangement in which ring shaped notches are discontinuously pressed step by step into a smooth pipe. The pipe provided with a corrugation produced by the notches is fed to a second arrangement in which the axial distance between the wave peaks and the corrugation produced in the first arrangement is reduced. The second arrangement consists of three parts which are connected to one another through springs acting in the axial direction of the pipe. The three parts interact in a two stage manner of operation, compress the corrugation of the corrugated pipe, and effect a forward movement of the pipe by means of the first arrangement by a step. In the first arrangement, another ring shaped notch is pressed into the pipe.

OBJECTS AND SUMMARY

The invention is based on the object of further developing the above mentioned method and corresponding device in such a way that a continuous manufacture of a corrugated pipe with compressed corrugation is possible.

In accordance with the invention, this object is met in that

- a clamping unit is used which consists of two separately arranged clamping devices, which are both placed in radial direction one behind the other tightly against the pipe provided with the corrugation,
- a first clamping device equipped with a drive is moved in operating position at the same speed as the pipe provided with the corrugation,
- the pipe provided with the corrugation is pressed continuously through the first clamping device against a fixed point realized by the second clamping device also equipped with a drive, wherein the second clamping device is arranged in relation to the corrugating device in an axial direction behind the first clamping device, and
- both clamping devices are cyclically removed from the pipe and each are moved in the opposite direction to the direction of movement of the pipe into a new position and, in this new position, are placed back against the pipe in the two different areas.

This method and the corresponding device operate continuously. The pipe is moved without interruption in its longitudinal direction through the corrugating unit and is correspondingly provided with a first corrugation. This first corrugation is a preliminary corrugation which is subsequently compressed into the desired corrugation. In accordance with known technology, the pipe is corrugated initially without a significant load acting on the material of the pipe. The narrower or also deeper corrugation is then achieved by the interaction of the two clamping devices which rest in different areas of the pipe tightly against the pipe. The second clamping device is then adjusted in such a way that it acts as a type of fixed point or realizes a fixed point against which the first clamping device presses the corrugated pipe with continuous feed. In this regard, the wave peaks of the corrugated pipe are moved closer toward each other, so that a pipe is produced which has an increased bendability.

Both clamping devices are moved back in a cyclical sequence while briefly releasing the pipe so as to be moved opposite to the direction of movement of the pipe and, the clamping devices are once again placed against the pipe. With respect to the first clamping device, this may occur for example, in those cases in which two wave peaks are pressed together. In the same manner, the cyclical return movement of at least the first clamping device may also occur after a compressed wave peak has passed. This cyclical return movement of the clamping devices may also occur if more than two wave peaks are pressed together. Both clamping devices can be moved back simultaneously.

Advantageously, they can also be moved back offset relative with respect to time, so that always one of the clamping devices rests in the appropriate area against the pipe.

The spacing of the wave peaks in the compressed area of the pipe can be adjusted by the type of movement to be used by the second clamping device. For example, the second clamping device may also be moved together with the pipe, however, with a speed which is lower as compared to the speed of the first clamping device. The second clamping device can also be placed only against the pipe without the use of a drive, i.e. at stand still. It is also possible to drive the second clamping device, during the continuous manufacture, in a direction which is directed opposite the direction of the movement of the first clamping device.

The two clamping devices advantageously consist of two parts constructed as half shells which, in the position of operation, can be locked together and thereby form a ring.

However, it is also possible to use clamping devices consisting of more than two parts. The parts of the clamping devices can, in the position of operation, be pressed only with sufficient force from the outside against the respective areas of the pipe. Advantageously, at least the first clamping device has at its inner surface at least one ring shaped or helically shaped rib which engages, in the position of operation, in a wave valley of the corrugated pipe. For the cyclical return movement of the two clamping devices, the parts thereof only have to be unlocked and removed from the pipe and once again placed against the pipe in the respectively new position. The return movement of the two clamping devices can advantageously be carried out automatically, for example, by means of their drives or by separate drives.

BRIEF DESCRIPTION OF THE DRAWINGS

Method and device according to the invention are explained with the aid of the drawings forming embodiments. In the drawing.

DETAILED DESCRIPTION

In the method and device according to the invention, a corrugation is pressed into an initially smooth pipe of metal, preferably of steel. The pipe can basically be prefabricated in any known manner.

In the following description, a technology for manufacturing a smooth pipe which is known per se, which is corrugated by means of the method and the device according to the invention. After its manufacture, the corrugation can be constructed so as to be helical, or advantageously ring shaped.

Figure 1:
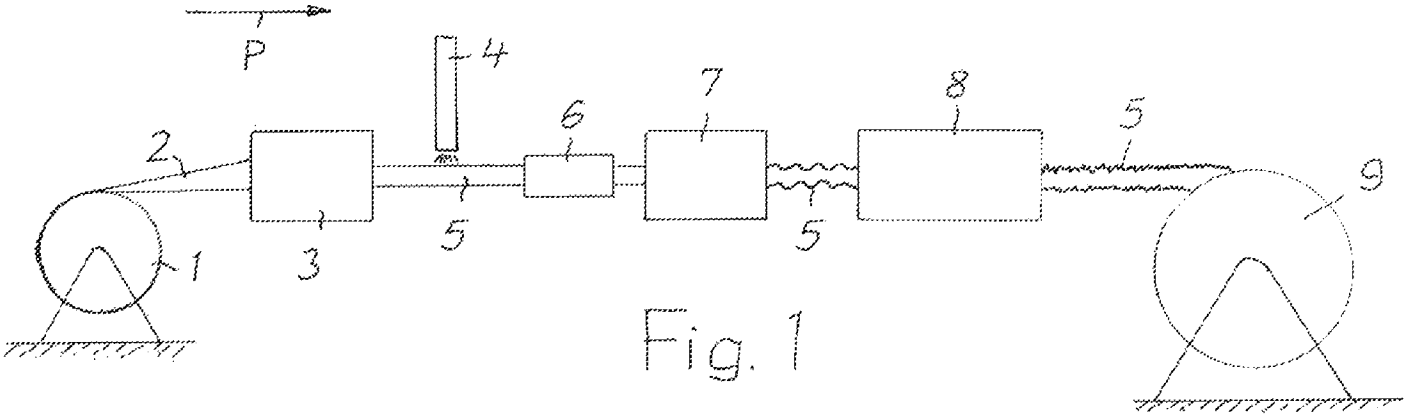
FIG. 1 is a schematic illustration for carrying out a method according to the invention.

In accordance with FIG. 1, a strip 2 preferably consisting of steel, is pulled off from a coil 1 and is fed in the direction characterized by an arrow P to a shaping unit 3. In the shaping unit 3, the strip 2 is formed into a slotted pipe by longitudinally entering the shaping unit 3. In the slotted pipe, the two edges of the strip 2 rest against each other at a slot extending in the longitudinal direction. The slot is welded in a welding device 4, so that a circumferentially closed and smooth pipe 5 is produced. For the movement of the strip 2 and the resulting pipe 5, a pull off device 6, which is known per se, can be used. The pull off device 6 can be a caterpillar pull off device or a pull off device employing clamping jaws.

Figure 2:
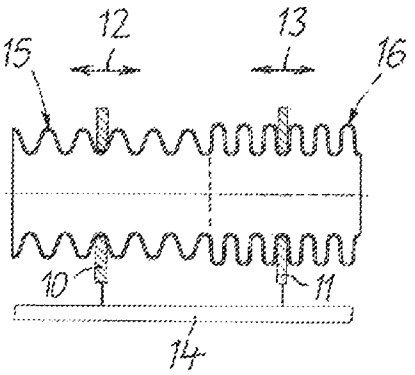
FIG. 2 shows a detail of FIG. 1 on a larger scale.

The finished smooth pipe 5 is then fed into an corrugating device 7 in which an corrugation extending transversely of its longitudinal direction is impressed as a preliminary corrugation which, as already mentioned, preferably extends in the shape of a ring. The pipe 5 provided with a preliminary corrugation is illustrated in the left part of FIG. 2. Subsequently, the pipe 5 provided with the corrugation is fed to a clamping device 8 whose construction and manner of operation are explained with the aid of FIGS. 2 and 3. By means of the clamping device 8, the preliminary corrugation is compressed. The shape of a pipe 5 provided with a compressed corrugation is illustrated on the right hand side of FIG. 2. The pipe 5 finished, in accordance with the invention, can be wound onto a coil 9.

The clamping unit 8 consists of two clamping devices 10 and 11 which are separate from each other and, in the position of operation, are fixedly secured at different areas of pipe 5. The two clamping devices 10 and 11 can be pushed parallel to the axis of pipe 5 along a schematically illustrated guide element, for example, a rail 14.

The clamping devices 10 and 11 are constructed as half shells which, in the position of operation, are locked together to form a ring while being tightly secured to pipe 5. Both clamping devices 10 and 11 engage, in the position of operation, in the corrugation of the pipe 5. At the beginning of the method, they rest against the pipe 5 provided with the preliminary corrugation. When carrying out the method, the clamping device 10 continues to rest against the area 15 of the pre-corrugated pipe 5, while the clamping device 11, during continuous manufacture, then rests against the compressed area 16 of the pipe 5 with the compressed corrugation.

Figure 3:
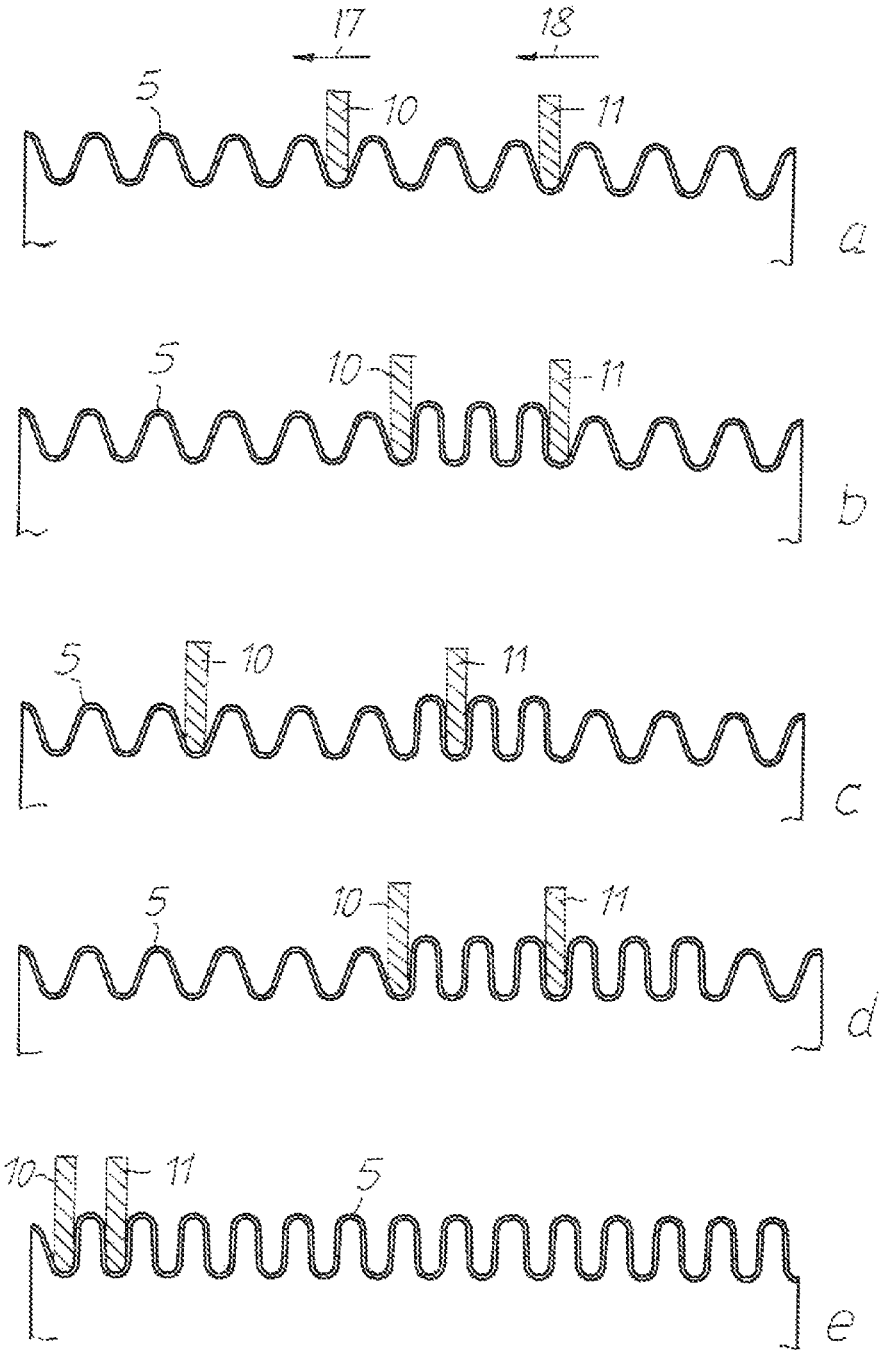
FIG. 3 shows different positions of a corrugated pipe and of the structural components used in carrying out the method.

The method according to the invention operates, as shown in the illustrations in FIG. 3, which for simplicity's sake, only show the corrugation and not the entire pipe, for example as follows:

The pipe 5 is continuously fed to the clamping unit 8 with constant speed. In accordance with FIG. 3*a*, the two clamping devices 10 and 11 are fed with axial spacing relative to each other to the pipe 5 provided with the preliminary corrugation. Accordingly, the clamping device 10 travels together with and at the same speed as the pipe 5. It is driven by a drive which is not illustrated.

The clamping device 11 is also equipped with a drive. For a further explanation of the method, it is initially assumed that the clamping device 11 is secured in a stationary manner by means of its drive at the beginning of the method. The clamping device 11 then holds the pipe 5 at the location where the clamping device is pressed against the pipe. This results in a fixed point against which the pipe 5, provided with a preliminary corrugation, is pressed by the first clamping device 10. The corrugation of the pipe 5 is compressed as a result in such a way that the spacing between the wave peaks is reduced. In this manner, the feed of the first clamping device 10 compresses the three wave peaks together, as illustrated in FIG. 3*b*.

At least the clamping device 10 must then be moved back in the opposite direction of the direction of movement of pipe 5 in accordance with the arrow 17 until it has reached its new position which is shown in FIG. 3*c*. The second clamping device 11, which only holds onto the pipe 5, could initially maintain its position, but could also be moved back in the direction of arrow 18 into the position shown in FIG. 3*c*. For the return movement, the clamping devices 10 and 11 are initially taken from the pipe 5 by releasing the parts of the two clamping devices 10 and 11 which had been joined together in the respectively new position. In the respectively new position, the parts of the two clamping devices are once again joined and locked together.

After the new positioning of at least the first clamping device 10, essentially the same process takes place as described above in connection with FIG. 3*a*. For example, three further wave peaks are then pressed together, so as to produce a configuration as illustrated in FIG. 3*d*. The two clamping devices 10 and 11 are advantageously moved backwards in the described sense, so that always a clamping device rests against the pipe 5.

In this sense, the method is carried out with a continuous cyclical feed of the pipe 5 until a predetermined number of wave peaks of the pipe 5 are pressed together. FIG. 3*e* shows a corresponding pipe 5. In that case, the first clamping device 10 is only shown for completeness sake.

The same manner of operation of the method is also applicable if the second clamping device 11 is driven with a lower speed and is moved together with the pipe 5 in the direction of movement thereof. In that case, the spacing of the compressed wave peaks is greater than in the embodiment with the stationary maintained second clamping device 11. If, in accordance with another variation of the method, the second clamping device 11 is driven in a direction which is opposite to the direction of movement of the first clamping device 10 or pipe 5, the pipe 5 is obtained whose wave peaks are pressed together more tightly than in the embodiment of the stationary second clamping device.

The invention claimed is:

1. Method of manufacturing a corrugated metal pipe, the corrugation having wave peaks and wave valleys, in which a corrugating device is used, said method comprising the steps of:

impressing a first corrugation as a preliminary corrugation into a pipe which is moved in its longitudinal direction through the corrugating device, said first corrugation having a given axial spacing between the wave peaks;

reducing the spacing between the wave peaks by subsequently obtaining a second corrugation by clamping devices resting against the pipe where two separately arranged clamping devices are both attached stationary in a radial direction, one behind the other tightly against the pipe;

moving a first clamping device of said clamping devices equipped with a drive in a position of operation with the same speed as the pipe, together with the pipe;

continuously pressing the pipe through the first clamping device against a fixed point defined by a second clamping device which is also provided with a drive that is arranged in relation to the corrugating unit in an axial direction behind the first clamping device to produce said reduced spacing between the wave peaks; and cyclically removing both said clamping devices from the pipe and moving each back in an opposite direction of the movement of the pipe; and resetting said clamping devices against the pipe in two new areas to be corrugate.

2. Method according to claim 1, wherein the second clamping device is driven in the same direction as the first clamping device, but with a lower speed than the first clamping device.

3. Method according to claim 1, wherein the second clamping device is driven opposite the direction of movement of the first clamping device.

4. Method according to claim 1, wherein the second clamping device is placed without the use of its drive tightly against the pipe.

* * * * *